US007465196B2

(12) United States Patent
Duarte et al.

(10) Patent No.: US 7,465,196 B2
(45) Date of Patent: Dec. 16, 2008

(54) WIRING HARNESS END CONNECTOR

(75) Inventors: Marc Duarte, Cedex (FR); Jean-Marc Nicolai, Cedex (FR); David Myotte, Cedex (FR); Fabrice Govin, Cedex (FR)

(73) Assignee: Valeo Vision, Bobigny, Cedex (FR)

( * ) Notice: Subject to any disclaimer, the term of this patent is extended or adjusted under 35 U.S.C. 154(b) by 0 days.

(21) Appl. No.: 11/176,997

(22) Filed: Jul. 7, 2005

(65) Prior Publication Data

US 2006/0099851 A1 May 11, 2006

(30) Foreign Application Priority Data

Jul. 9, 2004 (FR) ..... 04 07724

(51) Int. Cl.
*H01R 9/03* (2006.01)

(52) U.S. Cl. ..... 439/610; 439/394; 439/585

(58) Field of Classification Search ..... 439/63, 439/394, 578, 583–585, 610, 456–458, 471
See application file for complete search history.

(56) References Cited

U.S. PATENT DOCUMENTS

| | | | | |
|---|---|---|---|---|
| 3,622,943 | A * | 11/1971 | Reimer | 439/472 |
| 4,582,384 | A * | 4/1986 | Frantz et al. | 439/610 |
| 4,619,494 | A | 10/1986 | Noorily et al. | |
| 4,629,276 | A * | 12/1986 | Genaro et al. | 439/449 |
| 4,682,836 | A * | 7/1987 | Noorily et al. | 439/426 |
| 4,963,104 | A * | 10/1990 | Dickie | 439/460 |
| 5,273,459 | A * | 12/1993 | Davis | 439/607 |
| 5,584,727 | A | 12/1996 | Miller et al. | |
| 5,910,026 | A * | 6/1999 | Geib et al. | 439/471 |
| 6,045,390 | A * | 4/2000 | Metz et al. | 439/405 |
| 6,123,568 | A | 9/2000 | Bullough et al. | |
| 6,162,084 | A * | 12/2000 | Chen et al. | 439/336 |
| 6,475,021 | B1 | 11/2002 | Tan et al. | |
| 6,508,668 | B1 * | 1/2003 | Yamane | 439/582 |
| 6,644,999 | B1 | 11/2003 | Tan et al. | |
| 6,916,204 | B2 * | 7/2005 | Duarte et al. | 439/607 |
| 6,957,970 | B2 * | 10/2005 | Weigel et al. | 439/320 |
| 6,966,797 | B2 * | 11/2005 | Ko | 439/610 |
| 6,971,913 | B1 * | 12/2005 | Chu | 439/582 |
| 7,029,315 | B2 * | 4/2006 | Dang | 439/468 |
| 2003/0176090 | A1 | 9/2003 | Kozono et al. | |
| 2003/0194902 | A1 | 10/2003 | Huang | |

(Continued)

FOREIGN PATENT DOCUMENTS

DE 32 23 071 1/1984

(Continued)

OTHER PUBLICATIONS

French Search Report dated Mar. 4, 2005.

(Continued)

*Primary Examiner*—James Harvey
(74) *Attorney, Agent, or Firm*—Morgan & Finnegan LLP

(57) ABSTRACT

The present invention concerns a wiring harness end connector for an electronic module or an electronic card. It especially finds application in the case of connection of electronic modules contained in insulating cases, for example for vehicle headlights.

An orientation component carried by the first connector or the second connector allows the wiring harness to leave in any orientation relative to the orientation of the connector.

23 Claims, 6 Drawing Sheets

U.S. PATENT DOCUMENTS

| | | | | |
|---|---|---|---|---|
| 2003/0232539 | A1* | 12/2003 | Chen et al. | 439/610 |
| 2005/0266729 | A1* | 12/2005 | Fukushima et al. | 439/610 |
| 2006/0099851 | A1* | 5/2006 | Duarte et al. | 439/502 |

FOREIGN PATENT DOCUMENTS

| | | | |
|---|---|---|---|
| EP | 0112711 | A1 | 7/1984 |
| EP | 0525518 | A1 | 2/1993 |
| EP | 0525518 | B1 | 2/1993 |
| EP | 0 717483 | A1 | 6/1996 |

OTHER PUBLICATIONS

European Search Report pgs. from corresponding EP 05 29 1436 mailed Nov. 2, 2005 ( pgs.).

* cited by examiner

WIRING HARNESS END CONNECTOR

FIELD OF THE INVENTION

The present invention concerns a wiring harness end connector for an electronic module or an electronic card. It especially finds application in the case of connection of electronic modules contained in insulating cases, for example for vehicle headlights.

BACKGROUND OF THE INVENTION

In the prior art, such electronic modules are connected for example to a central computer, by means of a wiring harness, generally comprising a protective sheath, and a group or set of conductors, sometimes themselves insulated. Most often, the protective sheath also encloses an electromagnetic shielding braid and, in certain applications which can have an effect on the electromagnetic environment, a ferrite or plastoferrite core surrounds part of the extension of the harness.

The problem at the root of the invention consists of providing a shielded connection between an electronic module, such as an assembly containing a Xenon lamp and a high-voltage electronic module, and an electronic control module, whilst complying with the high-voltage insulation constraints, the constraints related to the electromagnetic standards, and the mechanical space requirement constraints.

In particular, the problem arises in that the wiring harness must comprise at each of these ends a connector intended to fit mechanically and electrically with a reciprocal connector on the electronic module to which it is connected. This characteristic of the presence of a connector on the harness leads to an increase in the space requirement and, depending on the mutual orientations of the connectors and the harness itself, the space requirement may increase considerably.

With this aim of reducing the space requirement of the assembly comprising harness and connector, it is known how to produce connectors which are mounted in line with the harness in various orientations, which are chosen so as to reduce this space requirement in the passenger compartment of a vehicle for example. Unfortunately, in each particular study for a given electronic module and an environment in which the module is placed, such as in a motor vehicle, it is necessary each time to redesign the connector and, at the very least, the interface area between the end of the harness and the connector itself.

In the prior art, for the same harness/electronic module pair, it is conventional to have a first part number for a harness with right-hand output and a second part number for a harness with left-hand output. This is the case in particular for the equipment of a vehicle headlight which is intended to equip a right-hand headlight or a left-hand headlight. The increase in the number of component part numbers is a source of difficulties and costs for the production and maintenance of assemblies using such wiring harnesses.

In particular, the choice of an orientation optimising the space requirement can also be constraining through an additional requirement for reducing the length of the wiring harness, which contributes in particular to decreasing the electrical losses, the electromagnetic radiation, the overall cost of the connection, and its weight in the vehicle. It is therefore particularly advantageous to provide a connector structure which makes it possible, throughout the design of the harness and the connector itself, to retain a freedom of choice of the relative orientation of the wiring harness and the connectors which are associated with its ends.

SUMMARY OF THE INVENTION

In order to solve the aforementioned problems of the prior art and achieve the objectives indicated, the present invention concerns an end connector for a shielded wiring harness, comprising a connector body comprising a shielding case made of conductive material, and characterized in that it comprises an orientation component capable of making the case and the body cooperate with means of shielding the wiring harness and of providing a relative orientation of the end of the harness and of the connector which can be selected so as to reduce the space requirement of the wiring harness, of the connector and of an electronic module or electronic card to which the connector is connected.

According to one aspect of the invention, the orientation component comprises an anchoring part fixed to the body of the connector.

According to one aspect of the invention, the anchoring part consists of a tab going into a passage in the body of the connector.

According to one aspect of the invention, the body of the connector comprises a case.

According to one aspect of the invention, the case surrounds an electrical contact area or tab support.

According to one aspect of the invention, the case is made up of two parts equipped with fixing means.

According to one aspect of the invention, the case comprises a projection on the side where the electrical wires of the wiring harness interface with the connector.

According to one aspect of the invention, the wiring harness comprises a shielding braid.

According to one aspect of the invention, the connector cooperates with a ferrule intended to grip the shielding braid and a corresponding part of the connector body.

According to one aspect of the invention, the ferrule and/or the shielding braid cooperate with a shielding device associated with the connector body.

According to one aspect of the invention, the shielding device cooperates with at least one electrical contact area or tab.

According to one aspect of the invention, the connector comprises at least one first and one second connection part.

According to one aspect of the invention, the orientation component makes two half-shells of the case and the body cooperate with the shielded braid.

Other characteristics and advantages of the present invention will be better understood with the help of the description and the accompanying figures amongst which:

DESCRIPTION OF THE PREFERRED EMBODIMENTS

Figure 1:
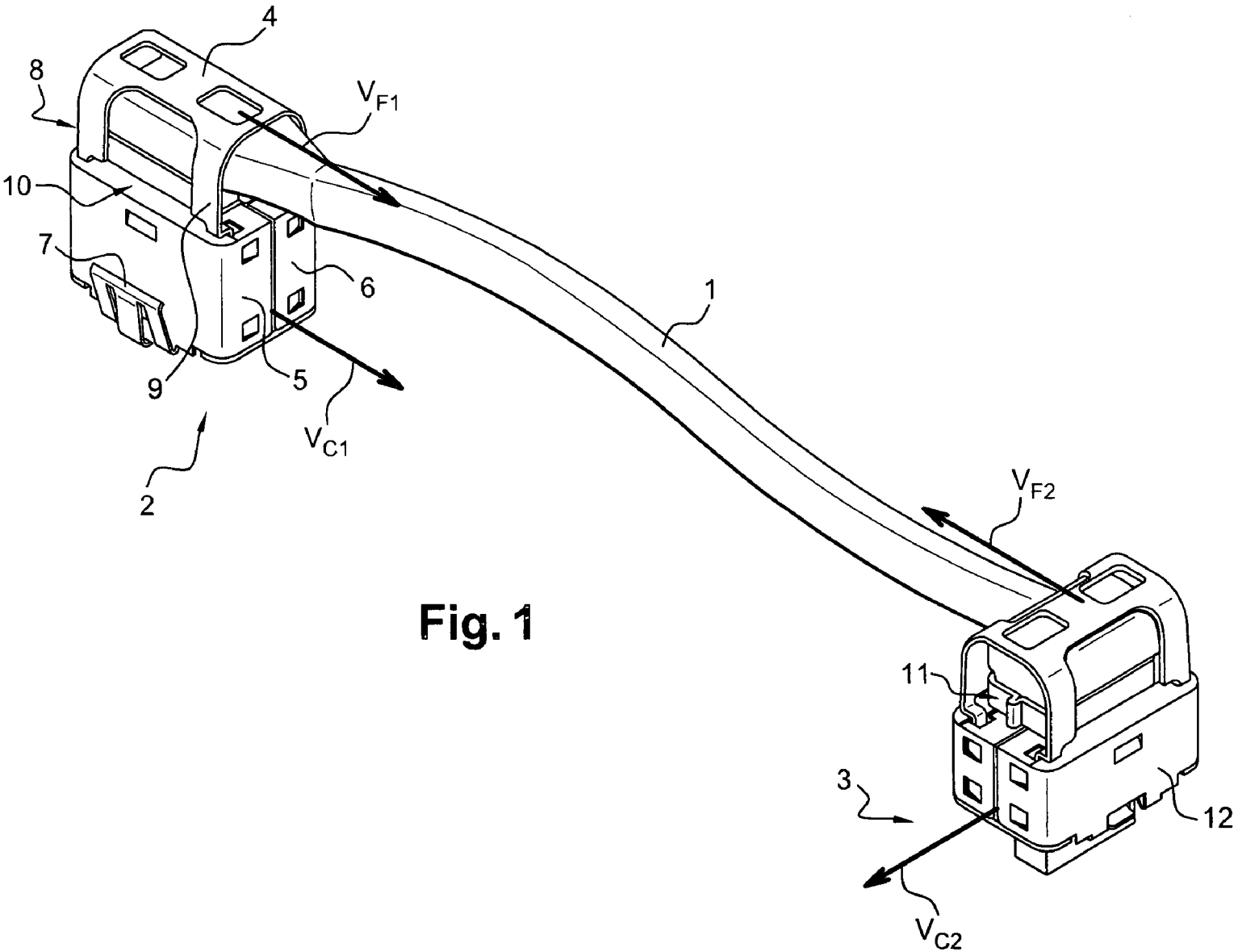
FIG. 1 depicts a wiring harness whose two ends are equipped with a connector according to the invention.

FIG. 1 depicts a wiring harness 1 which has two ends equipped with a first connector 2 and a second connector 3.

The connectors 2 and 3 have a substantially parallelepipedal shape, the largest dimension of which is oriented in the direction VC1 for the first connector 2 and in the direction VC2 for the second connector 3. Each end of the harness has an orientation along the vector VF1 and the vector VF2. It should be noted that the orientations VF1 and VC1 of the first connector 2 and of the first end of the wiring harness 1 are identical. It should also be noted that the orientations VF2 and VC2 of the second connector 3 and of the second end of the wiring harness 1 are in the same plane and orthogonal.

The first connector 2 and second connector 3 are similar and comprise two half-shells 5 and 6 which are assembled together by means of fixing means known to persons skilled in the art. Each half-shell such as the half-shell 5 has a spring 7 which is intended to guarantee continuity of the shielding of the connector 2 with the electronic module (not depicted) with which it is mechanically and electrically associated.

The first connector also comprises an orientation component 4 which is intended to become fixed to the upper part of the assembly consisting of the two half-shells 5 and 6. In order to carry out this fixing, the orientation component 4 is provided with tabs 8 and 9, and with two other tabs which are not visible in the drawing, but are symmetrical with the first two mentioned, and which go into housings provided for that purpose on the half-shells 5 and 6. In one particular embodiment, the orientation component 4 contributes to the fixing of the two half-shells to one another.

It should be noted that the orientation component has lateral openings so that four sides can be used for output of the harness 1. In particular, the orientation component has two large parallel sides and two small parallel sides. The wiring harness 1 leaves the first connector 2 through a small side. The wiring harness 1 leaves the second connector 3 through a large side.

In particular, on the second connector 3 in FIG. 1, a component 11 is depicted which is also visible on the first connector 2 under the reference 10. This component 10, 11 is a ferrule which makes it possible to achieve a permanent mechanical and electrical contact between part of the shielding braid and the half-shells.

Figure 2:
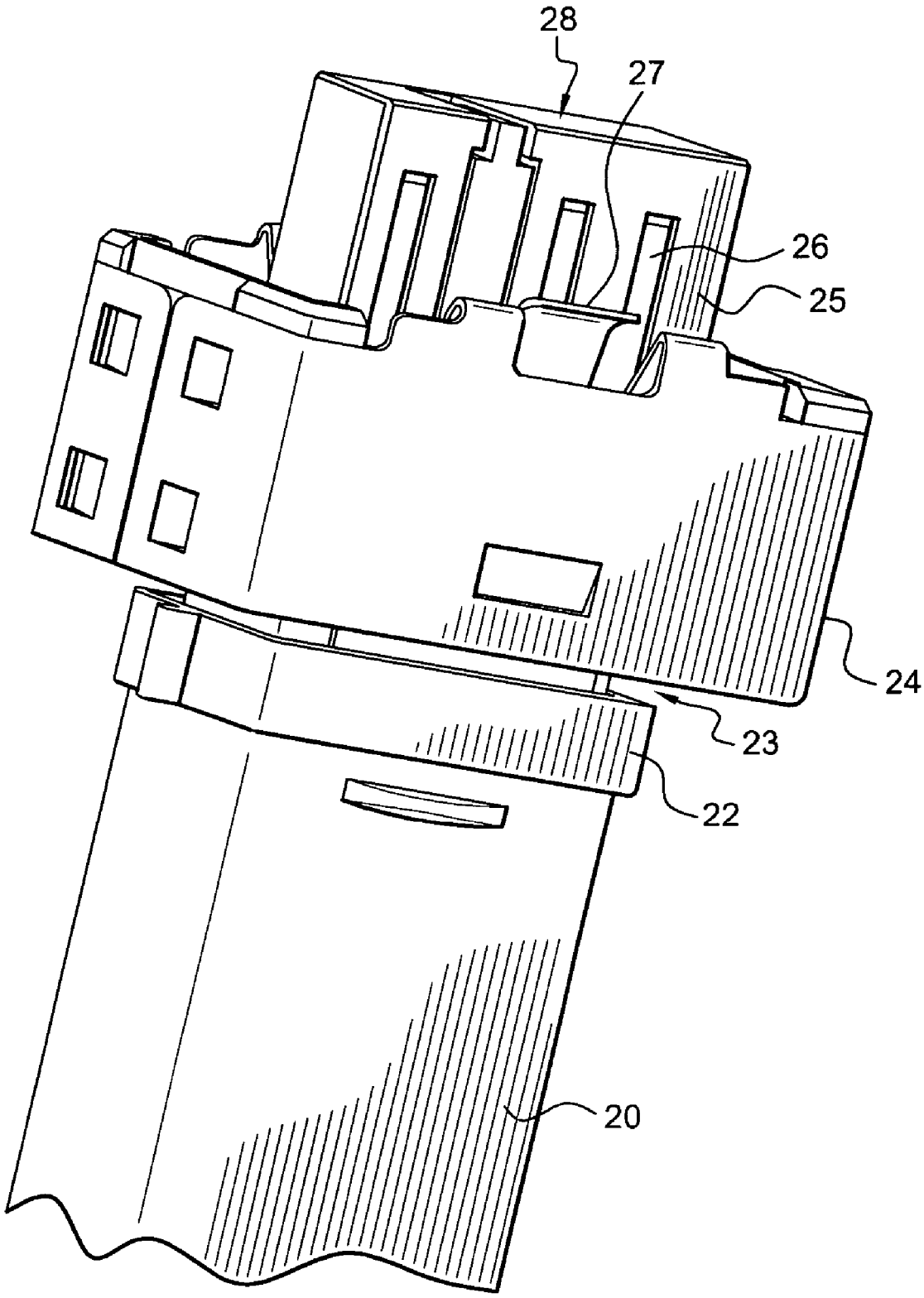
FIG. 2 depicts a variant of the first embodiment of the invention.

FIG. 2 depicts a particular embodiment of a connector according to the invention with a wiring harness end 20. The wiring harness end 20 carries the ferrule 22 which has descended to its end so as to systematically grip the shielding part of the wiring harness, visible in the drawing, and a tab 23 for continuity of the electrical earths with the shielding braid. The tab 23 is cut out of conductive metal and shaped so as to have one end which rests on a face 25 of an electrical tab support. Several electrical tabs have been depicted. In particular also, there should be noted at reference 27 a clipping part fixed to the half-shell 24 and which serves to fix a reciprocal part of a connector disposed on the electronic module with which the wiring harness will be associated.

Figure 3:
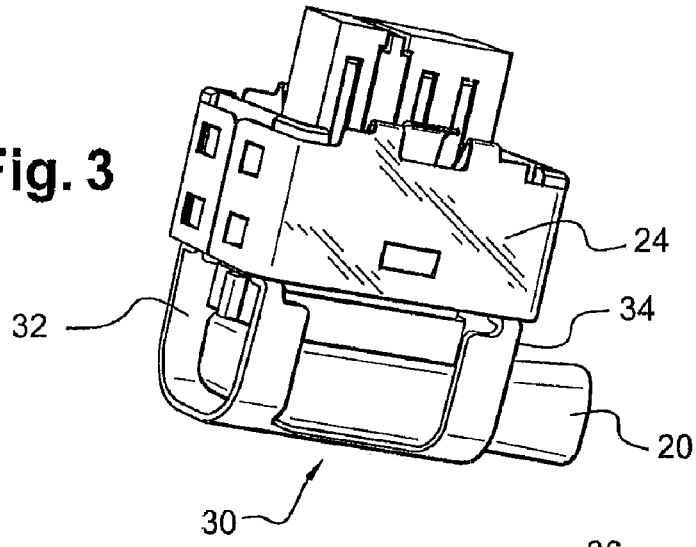
FIGS. 3 to 5 depict variants of the same connector in three different orientations with different orientation components.
Figure 4:
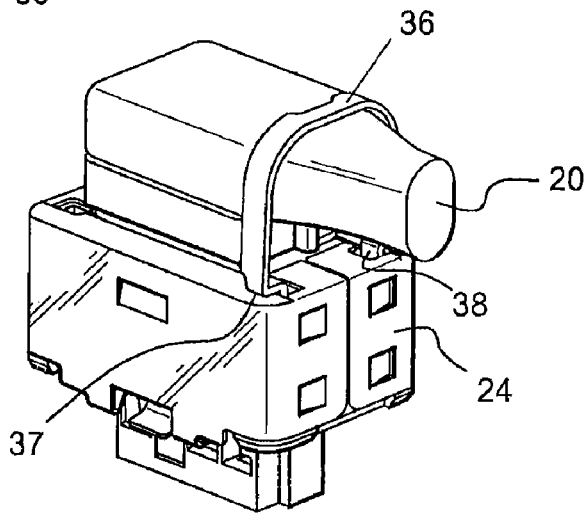
Figure 5:
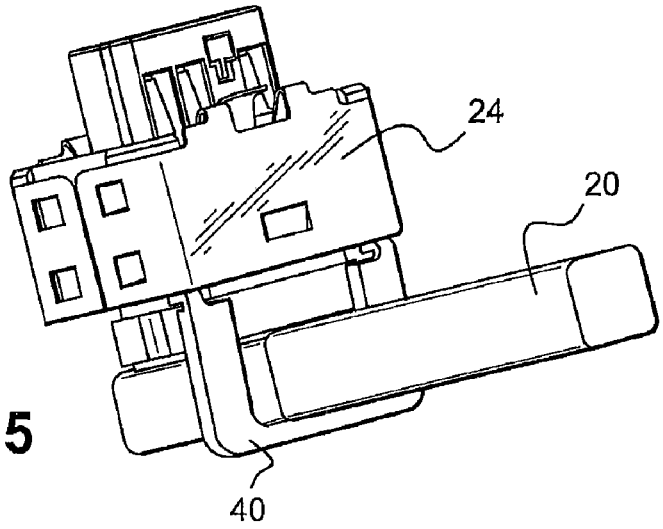

FIGS. 3 to 5 depict three particular embodiments of an orientation component useful for the connector of the invention. In FIG. 3, the orientation component consists of two arcs respectively 32 and 34, the ends of which, bent towards the cover 24, go into holes therein and are clipped thereto.

In FIG. 4, the orientation component is reduced to a single arc 37 and the ferrule cooperates with the orientation component 36 in order to keep a minimum space requirement whilst allowing the formation of a right-angled end of the end of the harness 20. The arc 36 is fixed to the case 24 by tabs 37 and 38 going into holes therein. The orientation component is disposed on the edge of a small side of the case 24.

FIG. 5 depicts another embodiment in which the orientation component in the shape of an arc 40 is disposed on a large side of the case 24.

For better understanding of the arrangement of the invention, an exploded view of a connector according to the invention has been depicted, but in an embodiment where it comprises more orientation components and in which the orientation of the wiring harness is perpendicular to the directions depicted in the preceding embodiments. The shielded braid at the end of the wiring harness 20 goes in underneath the ferrule so as to grip part 48*a* of the support of the electrical tabs 48 of the connector. As already described, the connector case consists of two half-shells 46 and 44 which have extensions 46*a* and 44*a* (FIG. 6) made of a conductive material so that the extensions 46*a* and 44*a* are covered by the shielded braid 20 itself surrounded by the ferrule 22. In this embodiment, a continuity of the shielding as far as the connector is thus achieved. Finally, a locking part has been depicted which is disposed in connection with the half-shell 44 and the support 48 of the electrical tabs.

Figure 7:
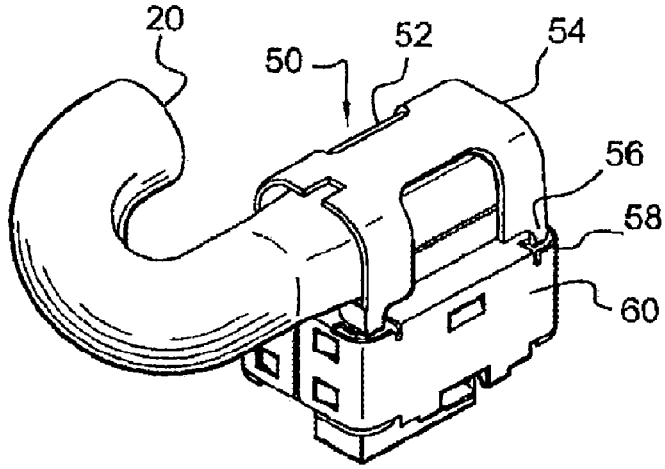

FIG. 7 depicts an embodiment with a single orientation component 50 with four fastenings onto the case 60 with an output of the wiring harness 20. In this embodiment, the hole 58 in the case 60 which accommodates a tab 56 on one of the fixing ends of the orientation component 50 has been depicted. The wiring harness 20 is oriented from a small side of the case and in a plane perpendicular to the direction of insertion of the connector 60.

Figure 8:
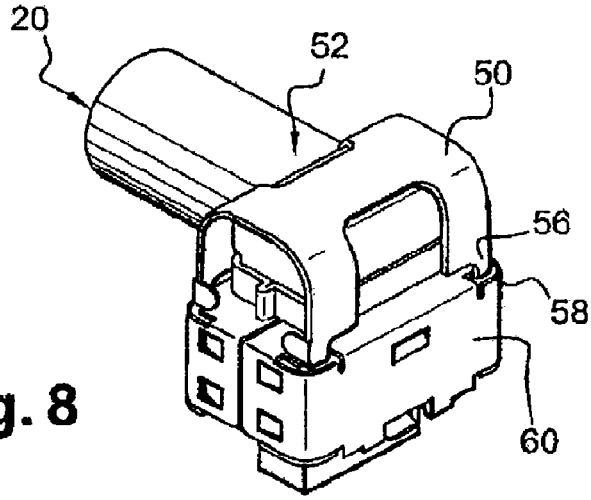

FIG. 8 depicts another embodiment in which, with the same equipment, the wiring harness 20 is oriented from a large side of the case 65 and is still in a plane perpendicular to the direction of insertion of the connector 60.

In one particular embodiment, the ferrule 22 is implemented by a mechanical part made from flexible aluminium.

Figure 6:
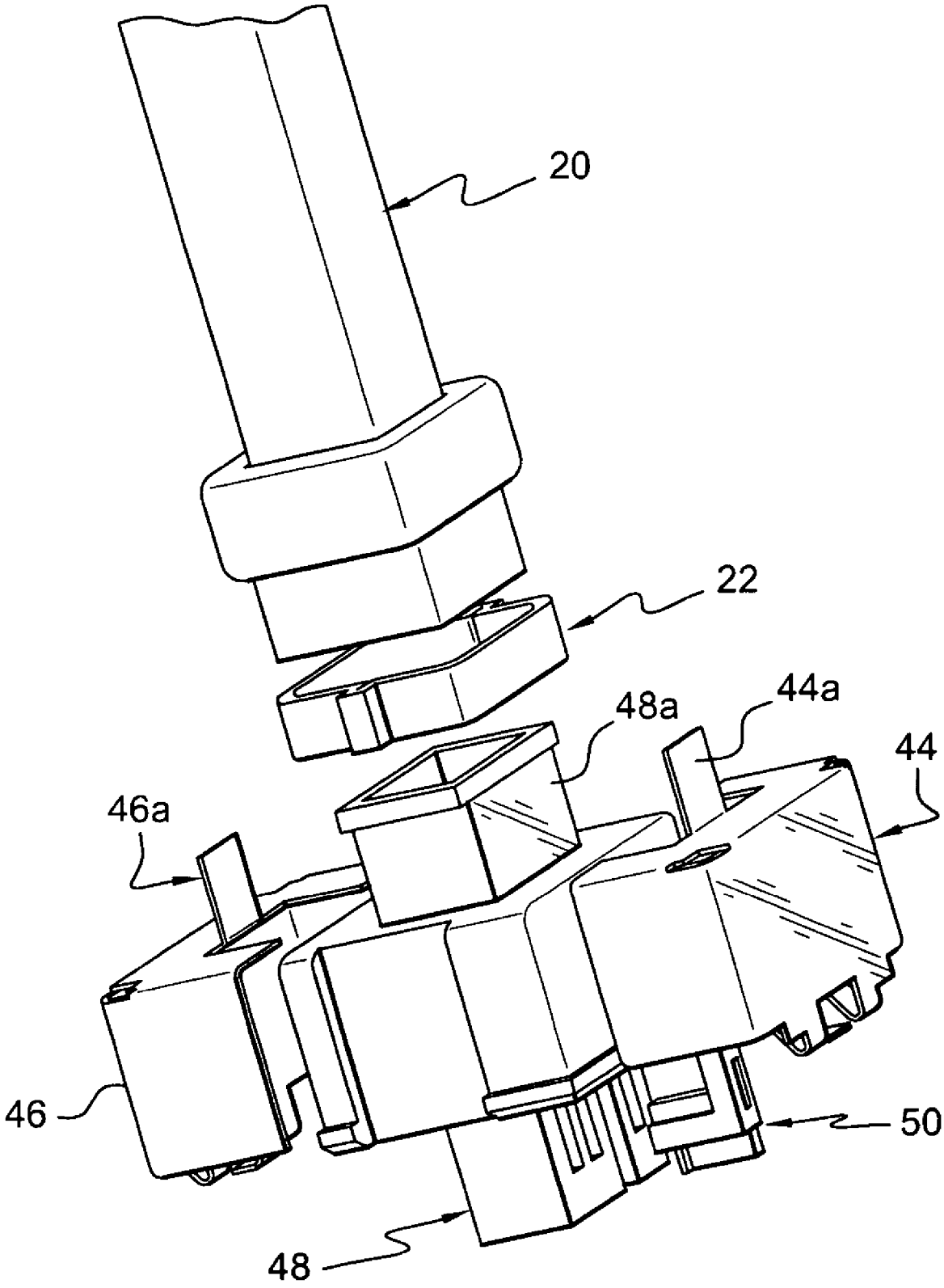
FIGS. 6 to 8 depict three variants of an embodiment of a connector according to the invention.

In one particular embodiment, the case 60 has conductive extensions as depicted in FIG. 6; it is itself made entirely from a conductive material.

In one particular embodiment, the invention uses a shielding device, the connector of the invention being connected on the one hand to a link conveying signals which interfere weakly in electromagnetic radiation terms, and on the other hand to a link conveying radiating signals which interfere sufficiently to interfere with the neighbouring signals on their contact areas. In this case, the shielding element is intended to surround only the set of interfering contact areas of the first link allowing connection with a shielding braid. As a result, in this case, it is not essential to shield the different sets of contact areas of the electronic card to which the connector is subsequently connected.

In such an arrangement, the connector of the invention comprises a first set of contact areas associated with the first electrical link connected to a receiving connector on the associated electronic card or module. The connector of the invention next comprises a second set of contact areas associated with the second electrical link and connected to another receiving connector on the associated electronic card or module. In this case, the shielding part is applied only to the first set of contact areas.

Figure 9:
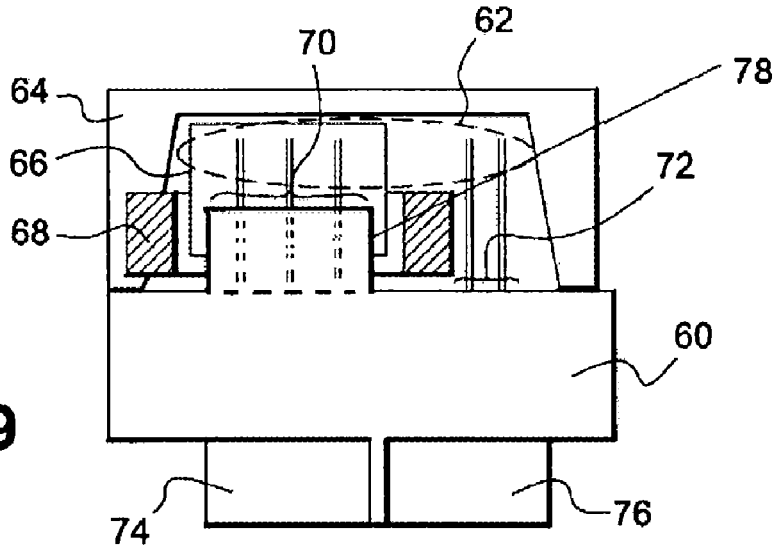
FIG. 9 depicts another embodiment of a connector according to the invention.

FIG. 9 depicts a particular embodiment according to what has just been defined. In this connector type, the wiring harness 62 is made up of at least two parts, a first part which is represented by the three wires 70 and a second part which is represented by the two wires 72. The invention has been depicted in the case where an orientation component 64 allows an output through a large side of the case 65 of the connector proper.

The first set of wires 70 is intended for an electrical link of strongly interfering signals. This set of wires 70 is therefore surrounded in a shielding braid 66 and ends at a first set of contact areas on the support 60 of the contact areas or tabs.

The second set of wires 72 is intended for an electrical link of weakly interfering signals. This set of wires 72 is therefore not inserted in the shielding braid 66, but can be combined in a single harness, in particular by means of bindings, or else by means of an insulating sheath coming above both the shielding braid 66 inside which the first set of wires 70 is located and the second set of wires 72. By virtue of the orientation component 64, the wiring harness, as explained with the help of the previous figures, takes an orientation perpendicular to the orientation of insertion of the wires on the support 60 of the contact areas or tabs.

In particular, a ferrule 68 is disposed around a protruding part of the case 60 so as to grip the shielding braid 66. The ferrule 68 may also include, if applicable, a shielding device 78 which does not need to be extended as far as the second set of wires 72.

In order to provide the electrical connection of the harness with an electrical module or an electronic card, the support case for the electrical contact areas or tabs 60 comprises:

a first connection part 74, here provided with at least three connection tabs to correspond to the three wires of the first set 70 of wires with, if applicable, an additional shielding continuity tab, if a shielding device is provided;

a second connection part 76, here provided with at least two connection tabs to correspond to the two wires of the second set 72 of wires.

Figure 10:
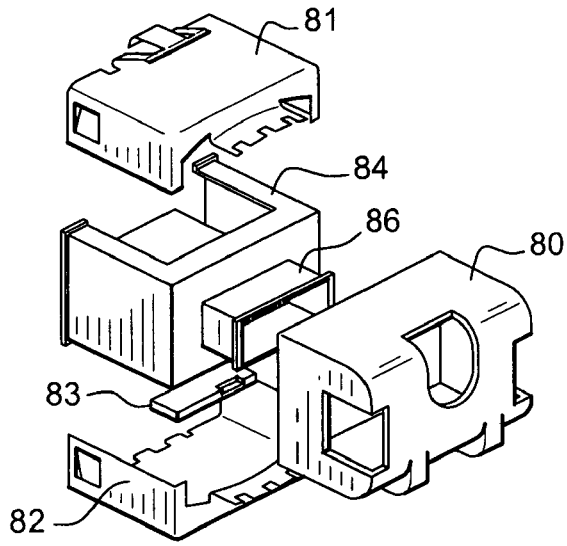
FIGS. 10 to 12 depict three views explaining another embodiment of a connector according to the invention.
Figure 11:
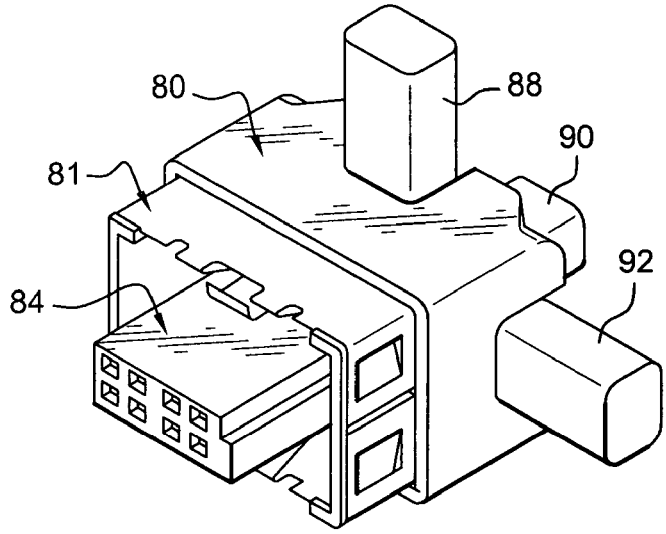
Figure 12:
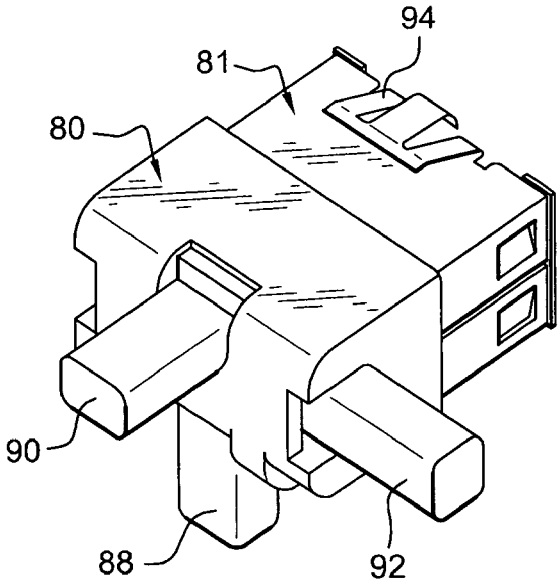

FIGS. 10 to 12 depict another embodiment of a connector according to the invention in which the orientation component makes the two parts of the case cooperate with the body and the braid.

FIG. 10 is an exploded assembly view in which the main components of the connector can be seen and in particular the half-shells 81 and 82, the body 84 with the part 86 for receiving the wires of the wiring braid, a ferrule part 83 and the orientation component 80 with four apertures allowing two times four orientations of a wiring braid, not depicted. This is because it is possible to direct the braid either in a vertical plane in which the four aforementioned apertures are situated or in the direction orthogonal to this plane.

FIG. 11 depicts an assembled connector using the same references as those of FIG. 10. The connector is seen here from the electronic module to which it is intended to be connected and three possible positions of the wiring braid have been depicted, in position 88 or 92 in the vertical plane of the four apertures of the orientation component or in position 90 along the aforementioned orthogonal axis. It should be noted here that the fitting in particular of the two half-shells 81 and the body of the connector 84 inside the orientation component provides complete holding of the connector.

FIG. 12, in which the same connector parts have the same reference numbers as in the previous figures, depicts the same connector seen from the side of the wiring braid whose three possible positions 88 to 92, already depicted in FIG. 11, have been included again. The disposition of a clipping component 94 intended to be fitted in a suitable notch of the reciprocal accommodating connector (not depicted) on the electronic module (not depicted) should be noted.

The present description does not describe any particular way for connecting the conductive end of an electrical wire with a contact area or tab inserted in the support case for the contact area or tabs such as the support 48 (FIG. 6). Persons skilled in the art know how to implement such an electrical connection by means of soldering, gluing, or else removal of insulation with a contact tab, one end of which has a cutting part intended to cut the insulation of the electrical wire.

What is claimed is:

1. End connector for a shielded wiring harness, comprising:

a connector body;

a shielding case made of conductive material; and an orientation component including at least two connection openings configured to receive the end of the harness and to provide at least two relative orientations of the end of the harness relative to the end connector;

wherein the connector body cooperates with a ferrule intended to grip the wiring harness and an extension of the connector body that is adjacent to the wiring harness.

2. The connector according to claim 1, wherein the orientation component comprises at least one anchoring part which fixes it to the shielding case.

3. The connector according to claim 2, wherein the anchoring part consists of a tab going into a passage in the shielding case.

4. The connector according to claim 1, wherein the shielding case surrounds an electrical contact area or tab support.

5. The connector according to claim 1, wherein the shielding case is made up of two parts equipped with fixing means.

6. The connector according to claim 1, wherein the shielding case further comprises an extension on the side where the electrical wires of the wiring harness interface with the connector.

7. The connector according to claim 1, wherein the wiring harness comprises a shielding braid.

8. End connector for a shielded wiring harness, comprising:

a connector body;

a shielding case made of conductive material; and an orientation component configured to receive the end of the harness and to provide at least two relative orientations of the end of the harness relative to the end connector, the orientation component including a planar portion located between at least two arc-shaped portions that extend substantially perpendicularly from the surface of the planar portion, wherein an interior of the arc-shaped portions faces toward the connector body when coupling the orientation component to the connector body via at least four anchor sites.

9. The connector according to claim 1, wherein the ferrule and/or the wiring harness cooperate with a shielding device formed in the connector body.

10. The connector according to claim 9, wherein the shielding device cooperates with at least one electrical contact area or tab.

11. The connector according to claim 1, further comprising at least one first and one second connection part.

12. The connector according to claim 1, wherein the orientation component makes two half-shells of the shielding case and the connector body cooperate with the wiring harness.

13. The connector according to claim 1, wherein the connector is a component of a system connecting a Xenon lamp with an electronic module.

14. The connector according to claim 1, wherein the connector body is composed of two half shells, and the orientation component secures the two half-shells of the shielding case together.

15. End connector for a shielded wiring harness, comprising:

a connector body;

a shielding case made of conductive material; and an orientation component including at least two connection openings configured to receive the end of the harness and to provide at least two relative orientations of the end of the harness relative to the end connector;

wherein the orientation component makes two half-shells of the shielding case and the connector body cooperate with the wiring harness, and a ferrule facilitates both mechanical and electrical contact between the wiring harness and the two half-shells of the shielding case.

16. The connector according to claim 1, wherein the orientation component is composed of one or more arc-shaped parts.

17. The connector according to claim 1, wherein the wiring harness is integrated with a shielded wire, the wire being shielded with a conductive covering.

18. The connector according to claim 17, wherein the conductive covering is braided covering.

19. The connector according to claim 17, wherein the conductive covering is a metallic tubular covering.

20. The connector according to claim 19, wherein the metallic tubular covering is flexible aluminum.

21. The end connector of claim 8, wherein the arc-shaped portions couple to the connector body via at least four metal tabs.

22. The end connector of claim 21, wherein the anchor sites include at least four receptacles located around the periphery of the connector body, the receptacles being configured to accept the at least four metal tabs.

23. The end connector of claim 8, wherein the arc-shaped portions are configured to provide different orientations for coupling the connector body to a wiring harness end.

* * * * *